US005961295A

United States Patent [19]

Haavik et al.

[11] Patent Number: 5,961,295

[45] Date of Patent: Oct. 5, 1999

[54] MIXED FLOW LIQUID RING PUMPS

[75] Inventors: Harold K. Haavik, South Norwalk, Conn.; Douglas Frederick Sweet, Birmingham, Ala.

[73] Assignee: The Nash Engineering Company, Trumbull, Conn.

[21] Appl. No.: 08/887,626

[22] Filed: Jul. 3, 1997

[51] Int. Cl.[6] ..... F04C 19/00

[52] U.S. Cl. ..... 417/68; 417/68

[58] Field of Search ..... 417/68

[56] References Cited

U.S. PATENT DOCUMENTS

| | | | |
|---|---|---|---|
| 1,180,613 | 4/1916 | Sieman . | |
| 1,718,294 | 6/1929 | Jennings . | |
| 3,712,764 | 1/1973 | Shearwood . | |
| 4,050,851 | 9/1977 | Haavik . | |
| 4,498,844 | 2/1985 | Bissell et al. | 417/68 |
| 4,521,161 | 6/1985 | Olsen et al. . | |
| 4,551,070 | 11/1985 | Olsen et al. . | |
| 5,213,479 | 5/1993 | Dardis et al. | 417/68 |
| 5,222,869 | 6/1993 | Wunner et al. . | |

FOREIGN PATENT DOCUMENTS

| | | |
|---|---|---|
| 880382 | 6/1953 | Germany . |

*Primary Examiner*—Timothy S. Thorpe
*Assistant Examiner*—Apollo T. Nguyen
*Attorney, Agent, or Firm*—Fish & Neave; Robert R. Jackson

[57] ABSTRACT

A conically ported liquid ring pump has one or more port structures with cone angles in the range from 15 degrees to 75 degrees. These cone angles are substantially greater than previously used cone angles (most commonly about 8 degrees). The large cone angles of this invention give the fluid flowing between the cone and the rotor significant components of both radial and axial velocity. Large cone angles also allow the port structure(s) to be made axially shorter, which has a number of important advantages such as shortening the unsupported length of the rotor shaft. These attributes of the present pumps are helpful for such purposes as allowing the length-to-diameter ratios of the pumps to be economically increased. In addition, the pumps of this invention retain many of the desirable attributes of conically ported pumps.

6 Claims, 4 Drawing Sheets

MIXED FLOW LIQUID RING PUMPS

BACKGROUND OF THE INVENTION

This invention relates to liquid ring pumps, and more particularly to the shape of the port members of conically ported liquid ring pumps.

Liquid ring pumps are commercially made in two well known configurations. One of these configurations is commonly called a flat sided design (see, for example, Siemen U.S. Pat. No. 1,180,613). In flat sided pumps the ports which direct the gas to be compressed into and out of the rotor are formed in a flat plate which runs with close clearance to the axial end of the rotor. The direction of the fluid entering and exiting the rotor is axial, that is, parallel with the rotor shaft; hence flat sided pumps are also called axial flow ported pumps. The other configuration is commonly called a conical design. In this design (see, for example, Shearwood U.S. Pat. No. 3,712,764) the gas ports are formed in a conical structure which fits with close running clearance to a conical recess inside the end of the rotor. The fluid flow path exiting the rotor through the cone port is substantially radial; therefore, conical design pumps are also called radial flow ported pumps.

The conical structures of known designs are constructed with a small taper angle, typically around 8 degrees or less. A special case where the port structure is cylindrical is also produced.

This specification discloses a new design characterized by a porting structure which supports significant components of flow in both axial and radial directions. For the purpose of distinguishing it from the prior art it will be termed a mixed flow port structure in this disclosure. This development offers several improvements in cost and performance of liquid ring pumps, especially those of very wide construction, which will be described below. The significance of these improvements is best understood by first examining the advantages and disadvantages of the prior construction methods.

The two known design configurations have distinct advantages and disadvantages associated largely with the porting configuration and the design constraints associated with either case. For instance, an axial flow or flat sided design has the following advantages over the radial flow conical design.

A flat sided port plate is potentially a simpler structure to manufacture than a radial flow cone. For instance, it can be fabricated from steel plate and ground flat through relatively economical machining processes. A cone is usually formed by a casting process and machined by a turning process which in some cases may be more expensive.

The flat sided head may be cast more easily since it is fully open on the side covered by the port plate. A radial flow conical head design is not as open, which complicates the support of coring used in the casting process.

The load on the shaft of a flat sided pump is distributed closer to the bearings, which may result in a smaller diameter shaft for an equivalent load. Also, the radial clearance between the rotor and stationary parts is not as critical as with radial flow conical pumps; therefore the shaft stiffness is less critical.

The rotor machining process for flat sided rotors does not include an operation for the radial flow cone recess.

The rotor blades of axial flow pumps are supported (reinforced) along the full length of the rotor hub, thereby minimizing any localized high stress areas. The blades in radial flow designs are not well supported in the area where the port is inserted, which may lead to areas of stress concentration.

Some of the disadvantages of the flat sided design relative to radial flow conical pumps are as follows.

The axial flow design may not be as efficient as radial flow conical pumps because the port velocities may be higher and cause higher entry and exit pressure losses. This becomes increasingly significant as the pump width relative to diameter increases. The port sizes of axial flow pumps are relatively fixed, independent of pump width. Radial flow ported pumps offer more dimensional control of the port velocities by varying the base diameter and/or length of insertion of the cone into the rotor.

In addition, the conical port structure offers a plenum under the rotor which better distributes the flow into and out of the rotor.

The axial direction of flat sided discharge flow limits the water handling ability of flat sided pumps. This disadvantage is explained as follows. The flow discharged from a liquid ring pump is inherently two-phase in nature—liquid and gas. A characteristic of two-phase flow is that the liquid component will not change direction unless acted upon by an external influence, for instance, by a guide vane. Since the flow direction within the rotor (relative to the rotor) is primarily radial, and there is no external influence other than the radial blades, excess liquid is more prone to stay within the rotor than to be discharged. This contrasts to a radial flow conical design in which the direction of liquid flow relative to the rotor is the same as the direction of discharge. Therefore, excess liquid in a radial flow conical design is readily discharged.

The consequence is that flat sided design performance is more adversely affected by liquid in the incoming gas stream than a radial flow conical pump. In the extreme this results in an earlier onset of cavitation and/or rotor breakage. Also, as with the port velocities, the problem associated with excess liquid increases as the pump width relative to its diameter increases. An axial flow port becomes more remote from the source of the problem as pump width increases, and this compounds the problem of purging excess liquid.

Flat sided pumps have reduced condensing ability relative to radial flow conical pump designs. Because of the higher inlet port velocities, the effect of introducing liquid spray into the inlet gas stream causes higher pressure drops in flat sided pumps than in conical pumps. Therefore the significant advantage of condensing the vapor content of inlet gas streams is reduced in flat sided designs. This problem is amplified by the inability of flat sided designs to safely handle as much liquid as a fraction of the gas/vapor volume, since condensing ability is directly proportional to the liquid fraction.

The performance of flat sided pumps is very sensitive to the axial clearance between the rotor and port plate. Hence it is often not practical to control flat sided clearances by the use of shims. This leads to a greater variation of performance of production lots of pumps. In a radial flow conical design constructed with, for instance, an angle of 8 degrees, there is a 7 to 1 amplification of the clearance setting. Therefore critical clearances between the rotor and cone can be controlled precisely with shim adjustments of the axial position of the parts and more uniformity in performance can be achieved.

As is evident from the above discussion, several of the advantages of flat sided pumps may lead to a lower manufacturing cost relative to conical pumps of the same displacement. However, the lower manufacturing cost comes at a sacrifice in performance, liquid handling, and condensing ability. These are attributes which contribute markedly to the reliability and marketability of the products. Also, it is apparent from the above discussion that the poor attributes of the flat sided design worsen as the relative width increases.

As is known by pump designers, a key to improving the cost of liquid ring designs is to extend the relative width. The reason for this can be explained by examination of the interaction between part diameter and part length on the cost of manufacturing processes. Experience shows that if the diameter is held constant, the cost of a pump divided by its displacement (expressed as dollars per cubic feet per minute or $/CFM) usually decreases as the width increases until a minimum point is reached; beyond that point the cost per displacement increases. The minimum point is determined by both mechanical and performance limits. For example, one of several factors is that the shaft diameter becomes so large that shaft cost becomes disproportionate and the size of the shaft takes away a disproportionate share of the bucket volume (volume between adjacent rotor blades), increasing dollars and dropping CFM.

Generally speaking, for prior art double ended pump designs (e.g., as in the above--mentioned Shearwood patent), the minimum $/CFM occurs at a cumulative axial rotor blade length (excluding the thickness of the end and center shrouds) of about 1.3 times the rotor diameter. A benefit of the mixed flow cone development is an extension of the minimum cost limit to axial rotor blade lengths beyond 1.3 times the rotor diameter, as will be described in detail below.

Jennings U.S. Pat. No. 1,718,294 shows conically ported liquid ring pumps with relatively large cone angles (approximately 18 degrees in FIG. 1 and approximately 12 degrees in FIG. 4). However, Jennings shows the rotor shrouded immediately adjacent to the ports in the cones and in such a way as to substantially preclude any axial component of fluid flow between the cones and the rotor.

In view of the foregoing, it is an object of this invention to provide improved liquid ring pumps.

It is a more particular object of this invention to provide liquid ring pumps which combine some of the benefits of both axial flow and radial flow pump designs.

It is still another object of this invention to provide liquid ring pumps having many of the advantages of radial flow design pumps, but which can be economically constructed with greater axial rotor blade length to rotor diameter ratios than are generally economical for known radial flow pumps.

SUMMARY OF THE INVENTION

These and other objects of the invention are accomplished in accordance with the principles of the invention by providing liquid ring pumps which may be generally like known conically ported pumps, but which have larger cone angles than have heretofore been known for conically ported pumps. Whereas a cone angle of approximately 8 degrees has for several decades been virtually an industry standard, the cone angle of pumps constructed in accordance with this invention is in the range from 15 degrees to 75 degrees. As a concomitant of significantly increased cone angle, the conical port structures of the pumps of this invention may have significantly shorter overall length than has been used in previous liquid ring pump designs. Increased cone angle helps to give the fluid flowing between the cone and the rotor a significant component of velocity in the axial direction. The space between the rotor blades adjacent the ports in the conical surface is open so that there is no rotor structure to interfere with this axial velocity component. Among other advantages, a significant axial fluid velocity component and axially shorter port structures facilitate achieving economical increase in the ratio of axial rotor blade length to rotor diameter. At the same time, the pumps of this invention retain all or most of the advantages of the conical design.

Further features of the invention, its nature and various advantages will be more apparent from the accompanying drawings and the following detailed description of the preferred embodiments.

DETAILED DESCRIPTION OF THE PREFERRED EMBODIMENTS

Figure 1:
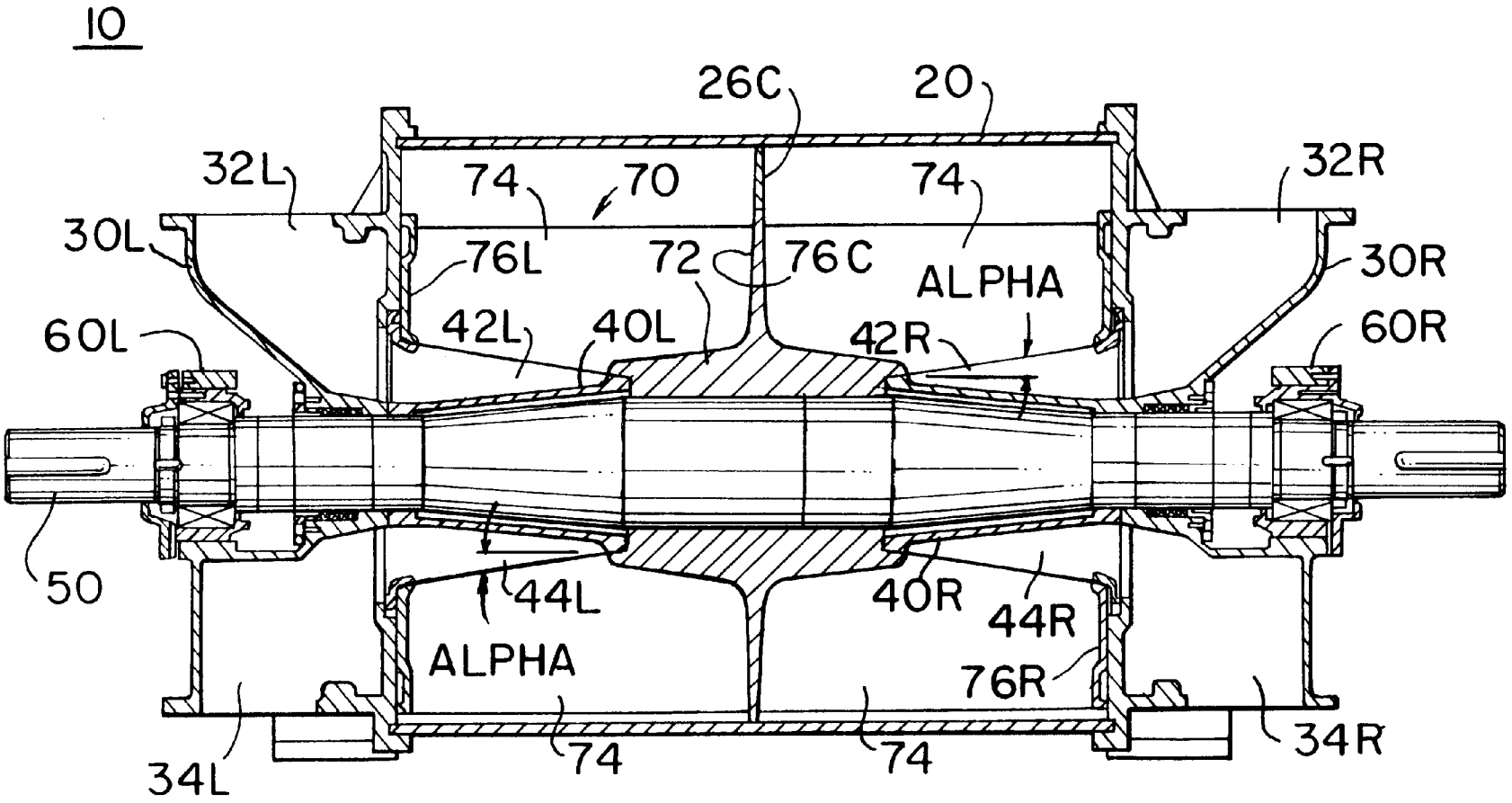
FIG. 1 (PRIOR ART)
FIG. 1 is a simplified sectional view of a typical prior art conically ported liquid ring pump.

FIG. 1 illustrates a conventional double ended pump 10 of radial flow conical design. Pump 10 includes a stationary annular housing 20 having head structures 30L and 30R fixedly connected to the respective left and right ends of the housing. A conical port member 40L or 40R is mounted on each head structure 30L or 30R, respectively. The angle ALPHA of the conical surface of each head structure 30 is approximately 8 degrees. Angle ALPHA is frequently referred to herein as the cone angle of the pump. Shaft 50 passes axially through housing 20, head structures 30, and port members 40, and is mounted for rotation relative to all of those structures by bearing assemblies 60L and 60R. Rotor 70 is fixedly mounted on shaft 50. Rotor 70 includes hub portion 72 and a plurality of blades 74 extending radially out from hub 72 and circumferentially spaced from one another around the hub. Each of port members 40 extends into an annular recess in the adjacent end of rotor 70. Rotor 70 also includes annular shrouds 76L and 76R connecting the respective left and right axial ends of rotor blades 74. An annular center shroud 76C also connects the midpoints of the rotor blades. An annular center housing shroud 26C (fixed to housing 20) is radially aligned with shroud 76C.

Housing 20 is eccentric to shaft 50 so that the upper portion of pump 10 as viewed in FIG. 1 constitutes the expansion or intake zone of the pump, and so that the lower portion of pump 10 as viewed in FIG. 1 constitutes the compression or discharge zone of the pump. In the expansion zone the liquid in the liquid ring of the pump is moving radially out away from hub 72 in the direction of rotor rotation. Gas to be pumped is therefore pulled into this portion of the pump via intake passageways 32L, 42L, 32R, and 42R. In the compression zone the liquid in the liquid ring of the pump is moving radially in toward hub 72 in the direction of rotor rotation. Gas in the pump is therefore compressed in the compression zone and discharged via discharge passageways 44L, 34L, 44R, and 34R.

Because of the relatively small cone angle (ALPHA=8 degrees) of the pump shown in FIG. 1, this pump is a so-called radial flow ported pump. Fluid flow across the conical interface between port structures 40 and rotor 70 is radial to a very large degree.

Figure 2:
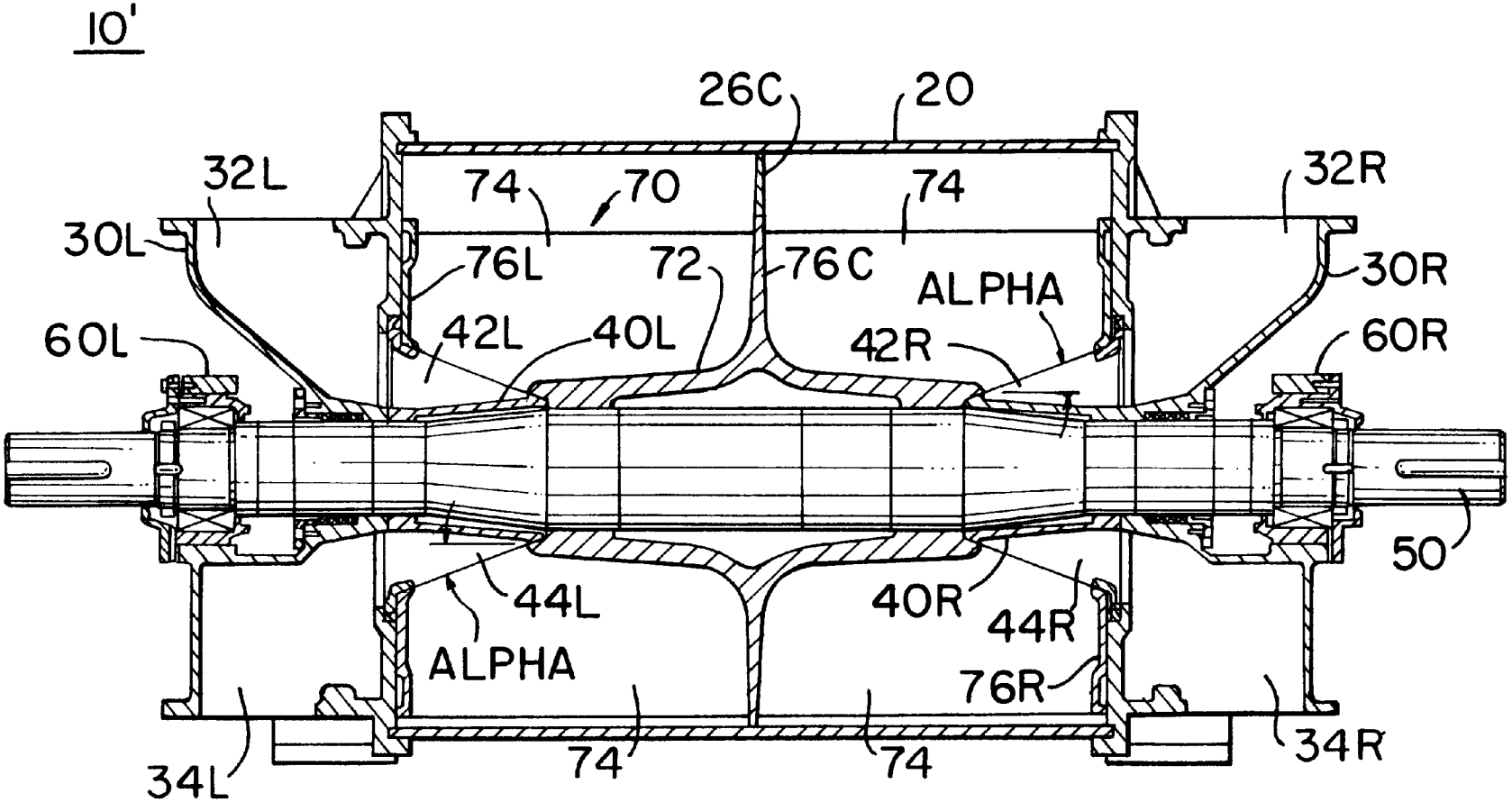
FIG. 2 is a view similar to FIG. 1 showing an illustrative embodiment of a liquid ring pump constructed in accordance with this invention.

FIG. 2 shows illustrative modifications of a FIG. 1 type pump in accordance with this invention. Thus FIG. 2 illustrates a pump 10' which is generally similar to pump 10, but which has a design based on the concept of mixed flow porting. In FIG. 2 and subsequent FIGS., reference numbers from FIG. 1 are repeated for generally similar elements. It will be understood, however, that the shapes of some of these elements are changed as is described in more detail below. The overall operation of pump 10' is similar to the overall operation of pump 10, albeit with improvements that are also described below.

Figure 3:
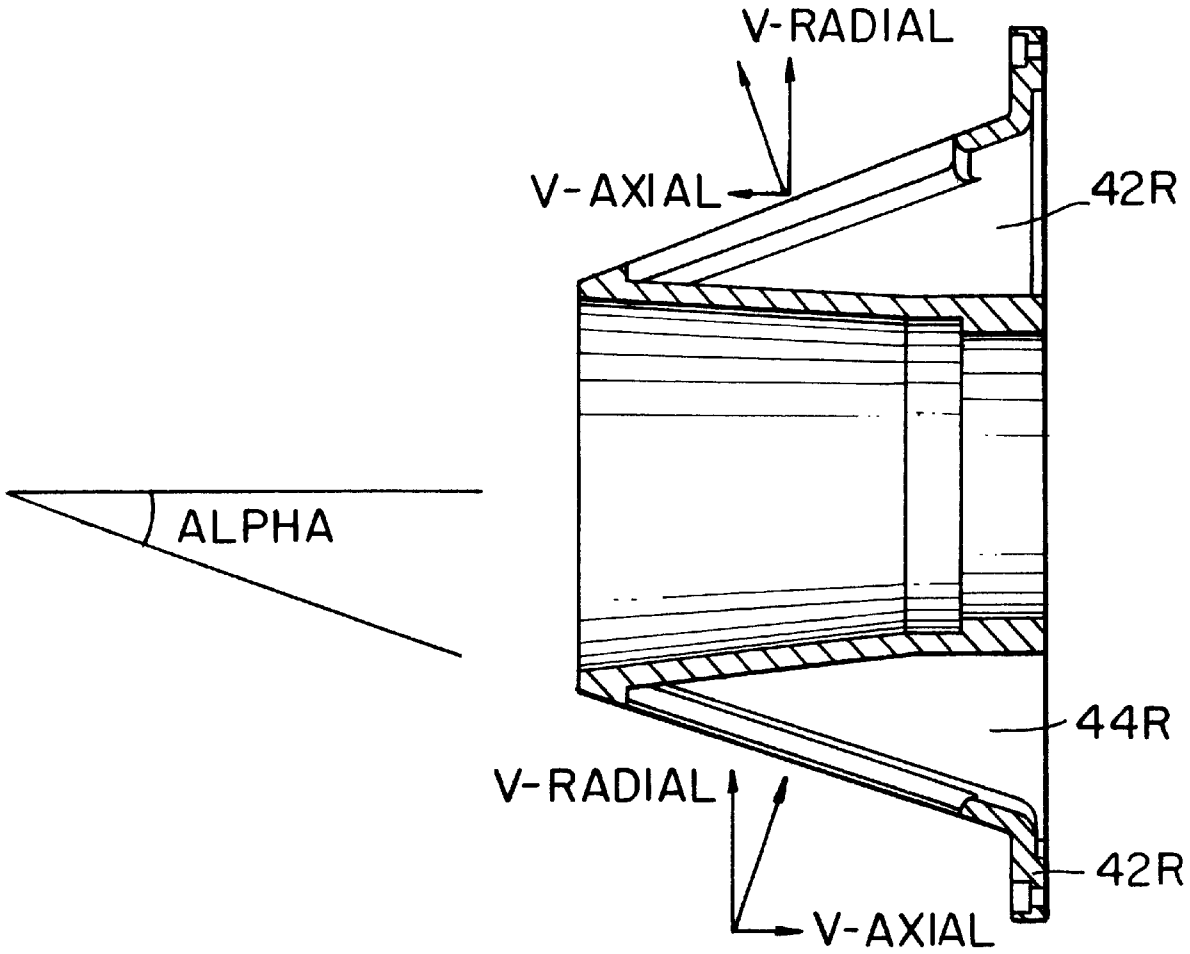
FIG. 3 is another view similar to a portion of FIG. 2.

FIG. 3 shows a conical porting element 4OR from FIG. 2 in more detail with arrows showing the components of flow direction. As shown, the fluid flow direction as it enters and leaves the rotor has significant velocity components V-RADIAL and V-AXIAL in the respective radial and axial directions.

In accordance with this invention, the flow can be considered mixed when the angle ALPHA of the cone is greater than about 15 degrees and less than about 75 degrees. This corresponds to a mixed flow axial flow component V-AXIAL which is greater than 25% of the absolute flow velocity at the surface of the cone. The illustration in FIG. 3 has a 20 degree cone angle ALPHA.

Figure 4:
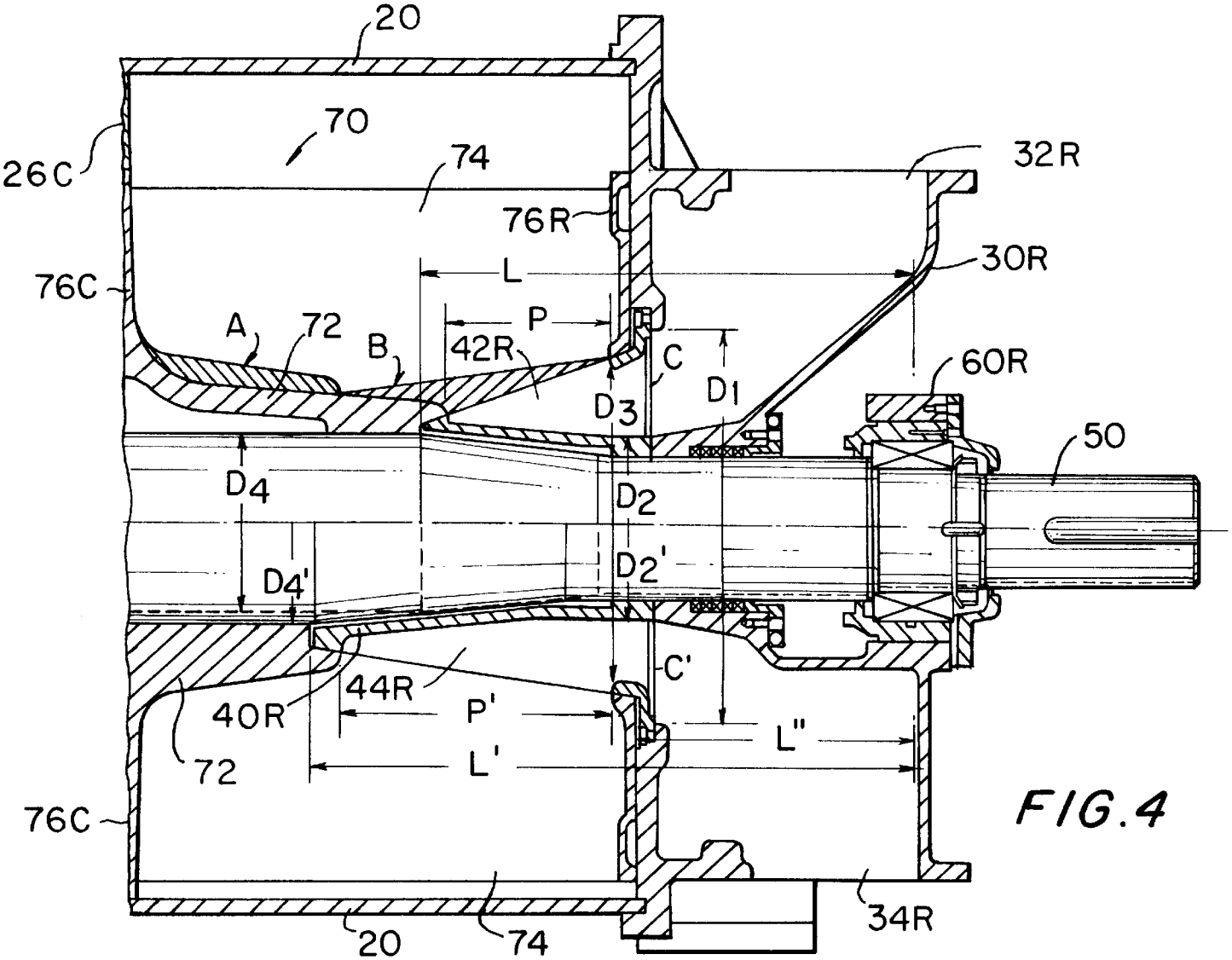
FIG. 4 is still another view similar to a composite of portions of FIGS. 1 and 2.

FIG. 4 contrasts the two designs described above. The top half of FIG. 4 shows the mixed flow design as in FIGS. 2 and 3; the bottom half shows the radial flow design as in FIG. 1. The radial flow design requires a larger shaft 50 as will be explained. The difference in shaft diameters is illustrated by the dash and solid lines in the bottom section. The largest part of the shaft diameter is D4. The two sides are drawn for the same base cone 40 dimension D1.

The mixed flow design has significant advantages over the prior methods of construction which are especially appropriate toward the design of very wide liquid ring pumps, that is, designs which have axial rotor blade length greater than about 1.3 times the rotor diameter. The advantages are described as follows.

As shown in FIG. 4, the head open area C for the mixed flow design is larger than the equivalent area C' for the radial flow design. This is because the inner diameter D2' is larger than D2 because of the larger shaft under D2'. FIG. 4 also shows labeled areas A and B which represent the difference in rotor bucket volume between the two designs; the mixed flow design has more bucket volume. If the radial flow cone structure 40 were modified to reduce the volume loss (by reducing diameter D1), there would be a large reduction in the area of the head port structure opening at C. Alternatively, if the radial flow structure is left as shown, the rotor 70 would need to be longer to achieve the same volume as the mixed flow design.

The net improvement is that the support of the cores used to form the passages in the head casting 30 is improved (made larger). Thus, the head castability is improved, while not losing rotor volume or extending the length of the rotor.

Also in FIG. 4 it is seen that the cone "throat" or minimum flow area through the base of the cone is made larger without a loss of rotor volume. This area is controlled by diameters D2 and D3. D3 is established by the cone base diameter less the wall thickness. D2 is established by the shaft diameter plus the cone inner wall thickness. (The wall thicknesses may be assumed fixed for the purpose of this discussion.) D3 is controlled by the same factors controlling D1 as described in the two preceding paragraphs. Therefore, the mixed flow port structure 40 allows a larger throat for gas and liquid flow without the loss of rotor volume and with a smaller diameter shaft than a radial flow cone port structure of the same base diameter.

The mixed flow porting structure 40 may be made shorter in length than radial flow cones. With radial flow cones 40, designers have believed that characteristic conical pump operating advantages of efficiency and large liquid flow component were associated with maximizing the insertion length P' of the cone relative to the rotor length. The insertion length was generally greater than 45%, typically in the range of 50 to 60%, of the overall rotor length.

It has been determined that good conical pump operating characteristics may be maintained by using a much shorter port length P. For instance, a port length less than about 45% of the rotor length served by the port can be used. The upper part of FIG. 4 shows a port length P which is about 34% of the relevant portion of rotor length (between shrouds 76C and 76R.)

The impact of the shorter mixed flow port length is significant in terms of very wide liquid ring pump design. As was noted previously, the critical unsupported or unreinforced distance L between the rotor hub 72 and bearing 60 is significantly reduced. Since the overall shaft 50 deflection is proportional to the cube of this distance, the effect is a dramatic reduction in shaft diameter for comparable deflection of a radial flow design (with relatively large length L') to the new design (with relatively small length L).

Furthermore, the mixed flow cone 40 allows more shaft 50 deflection without interference than a radial flow cone 40 assembled with the same running clearance. The running clearance is measured perpendicular to the surface of the cone. As the taper angle ALPHA increases, the allowable radial travel of the rotor 70 is proportional to 1 over the cosine of the angle. For instance, a mixed flow cone of 20 degree taper angle ALPHA may deflect an additional 5% without interference compared to a radial flow cone of 8 degrees.

Although in an axial flow or flat sided design the distance between the rotor hub and bearing is shorter still (for instance, L" as shown in FIG. 4), the mixed flow port 40 may reduce the significance of this length to the extent that other factors will prevail in determining the shaft 50 size. For instance, the shaft size will be limited by factors such as the torsional strength of the shaft drive end and/or the shaft journal size required for bearings 60 to support the required hydraulic load. Therefore the mixed flow shaft 50 will be sized near or on the same basis as the equivalent flat sided shaft size.

The mixed flow port structure 40 and rotor 70 are less expensive to manufacture. Because the port structure 40 is shorter in length, its weight and overall manufacturing cost are less than a conventional conical structure 40. Also the machining cost of the conical recess in the rotor 70 is reduced because it is shorter.

The shorter conical recess in the rotor 70 of the mixed flow design also results in a stronger rotor blade 74 than a conventional radial flow design. Although the blade 74 section in the conical recess is still unsupported in the mixed flow design, in many cases the significance of the unsupported length in comparison to a flat sided design is lessened to the extent that (as with the shaft 50 design) other factors will prevail in arriving at the required blade 74 thickness. For instance, blade thickness may be decreased to the point that minimum wall thickness for good casting design is the determining factor, not the blade stress.

Overall, the above improvements are capable of putting the cost of mixed flow pumps equal to or lower than axial flow ported pumps, especially when employed in very wide (i.e., axially long) liquid ring pump designs. The improvements move the minimum $/CFM point of double ended liquid ring pump designs beyond the aforementioned 1.30 times diameter.

Although the above discussion has been directed to pumps of double ended design, the advantages of the invention also apply to single ended designs, that is, pumps which are constructed with only one port member 40 on one end of the rotor 70. For single ended designs the above discussion also applies, except the minimum $/CFM conventionally occurs at a different width, for instance, at axial rotor blade length (excluding end shrouds) around 1.05 times rotor diameter, instead of 1.3 times rotor diameter for double ended designs. Thus this invention makes it economical to construct single ended liquid ring pumps having axial rotor blade length greater than 1.05 times rotor diameter.

As can now be understood, the mixed flow design offers possible improvement over the manufacturing cost advantages of the flat sided design, while at the same time maintaining performance characteristics which may approach those of the conical design. For instance, the efficiency advantage of the radial flow design is maintained because the mixed flow port 40 openings may still be constructed with open flow areas which minimize pressure drops through the ports and with a large plenum area which distributes the flow into the rotor 70. The important advantage of handling condensing water spray at the inlet is not compromised. Also, the mixed flow design still allows excess liquid to be expelled from the rotor 70 in the radial direction. Hence the water handling advantage of radial flow porting is not lost.

Therefore a blend of the best attributes of each of the prior configurations is possible. The mixed flow design makes possible the construction of a pump that may equal or improve on the cost effectiveness of the flat sided design, while approaching or equaling the efficiency and process tolerance of the radial flow conical design.

The invention claimed is:

1. A liquid ring pump comprising a port structure which extends into a recess in an axial end of a rotor, the rotor having a plurality of axially extending blades which extend radially out from the recess and which are spaced from one another around the recess, the port structure immediately adjacent to the recess defining a frustoconical surface having a cone angle in the range from 15 degrees to 75 degrees, the surface defining fluid inlet and outlet apertures for selectively communicating fluid between the port structure and spaces between adjacent blades, and the rotor immediately adjacent to the apertures being free of any structure other than the blades for influencing flow direction of fluid communicated via the apertures.

2. The liquid ring pump defined in claim 1 wherein the apertures have a maximum dimension measured parallel to the longitudinal axis which is less than 45% of the axial extent of the blades served by the apertures.

3. The liquid ring pump defined in claim 1 wherein the port structure is the sole port structure in the pump, and wherein the ratio of the axial length of the rotor blades to the rotor diameter is greater than 1.05.

4. The liquid ring pump defined in claim 1 further comprising a second port structure which extends into a second recess in a second axial end of the rotor opposite the previously defined axial end, the blades also extending radially out from the second recess and being spaced from one another around the second recess, the second port structure immediately adjacent to the second recess defining a second frustoconical surface having a second cone angle in the range from 15 degrees to 75 degrees, the second surface defining second fluid inlet and outlet apertures for selectively communicating fluid between the second port structure and second spaces between adjacent blades, and the rotor immediately adjacent to the second aperture being free of any structure other than the blades for influencing flow direction of fluid communicated via the second apertures.

5. The liquid ring pump defined in claim 4 wherein the second apertures have a maximum dimension measured parallel to the longitudinal axis which is less than 45% of the axial extent of the blades served by the second apertures.

6. The liquid ring pump defined in claim 4 wherein the ratio of the axial length of the rotor blades to the rotor diameter is greater than 1.30.

* * * * *